United States Patent [19]

Zimmer

[11] Patent Number: 4,875,676

[45] Date of Patent: Oct. 24, 1989

[54] WEIGHT LIFTING MACHINE FOR SAFE FREE-BAR BENCH PRESS EXERCISING

[76] Inventor: Karl A. Zimmer, 36652 Chester, Avon, Ohio 44011-1046

[21] Appl. No.: 220,517

[22] Filed: Jul. 18, 1988

Related U.S. Application Data

[63] Continuation-in-part of Ser. No. 72,675, Apr. 13, 1987, abandoned.

[51] Int. Cl.[4] ..... A63B 13/00

[52] U.S. Cl. ..... 272/123; 272/144; 272/DIG. 4

[58] Field of Search ..... 272/117, 123, 134, 144, 272/DIG. 4

[56] References Cited

U.S. PATENT DOCUMENTS

| | | | |
|---|---|---|---|
| 4,252,314 | 2/1981 | Ceppo | 272/117 |
| 4,256,301 | 3/1981 | Goyette | 272/123 |
| 4,286,782 | 9/1981 | Fuhrhop | 272/117 |
| 4,492,375 | 1/1985 | Connellt | 272/134 |
| 4,564,194 | 1/1986 | Dawson | 272/123 |
| 4,582,319 | 4/1986 | Luna | 272/123 X |
| 4,650,186 | 3/1987 | McCreery et al. | 272/134 |
| 4,709,922 | 12/1987 | Slade, Jr. et al. | 272/123 |

*Primary Examiner*—Richard J. Apley
*Assistant Examiner*—Robert W. Bahr
*Attorney, Agent, or Firm*—Donald A. Bergquist

[57] ABSTRACT

A weight training apparatus that allows the user to safely perform free-bar type bench press exercises, both in the standard fashion and in the more effective eccentric contraction fashion is described. The weight bar is attached to a cable system that incorporates a safety stop to prevent the weight bar from crushing the chest of the user in case of accident and especially features a guided sled proximal the user's feet and connected to the weight bar by the same cable system and whereby the user may, at his option at any time during the exercise, partially support or lift the weight bar by engaging the guided sled with his feet and pushing it using his leg muscles.

12 Claims, 2 Drawing Sheets

WEIGHT LIFTING MACHINE FOR SAFE FREE-BAR BENCH PRESS EXERCISING

This application is a continuation in part of Ser. No. 072,675 filed Apr. 13, 1987, now abandoned.

INTRODUCTION

This patent describes a weight training apparatus that allows the user to safely perform free-bar type bench press exercises, both in the normal, standard fashion and in the more effective eccentric contraction fashion. The weight bar is attached to a cable system that incorporates a safety stop to prevent the weight bar from crushing the chest of the user in case of accident and especially features a guided sled means connected to the weight bar by the same cable system and whereby the user can, at his option at any time during the exercise, partially support or lift the weight bar by pushing with his feet using his leg muscles.

Many weight lifting exercise machines have been developed and patented over the years. The goal of most of these machines is to provide safe and convenient exercise during which weights, which are either remotely located and operated by cables and pulleys or mounted locally as on a weight bar, are lifted against the force of gravity. These machines, with few exceptions comprise a captive weight, or a weight that is supported in the machine in a manner that the user need exert a force only in a generally upward direction to perform the required exercise. Balance and coordination of effort by various muscles involved in the lifting process are not necessarily used when using such apparatus. Many weightlifters and bodybuilders are returning to what is called "free-bar" exercises after having used such other equipment. "Free-bar" exercises are those wherein the control and balancing of the weight is the total responsibility of the user. They have found that the exercise machines available to them are suitable for exercising the large muscles of the body, but, because they do not require the user to control the weight in terms of balancing it, these machines fail to provide proper exercise for the finer muscles that are so important in balancing. One can readily imagine an athelete who has been trained exclusively on weight training machines having captive weights and who is therefore fully capable of lifting a weight, but is incapable of controlling the weight once it is lifted.

The weight lifting exercise known as the bench press requires a weightlifter to lie in a substantially supine position on a bench under a weight bar that carries a preselected amount of weight evenly distributed on the ends of the bar. It should be understood that in most cases the bench is horizontal, although in some cases the bench or a part thereof may be inclined, usually with the user's head higher than his torso; in either case, we consider the user's position to be supine, by which reference we embrace the horizontal and the inclined orientations. The weight bar is then lifted off the rack (attached to the bench at nearly the full extension of the user's arms) and brought down to the user's chest. The exercise comprises lifting the weight from the chest to the full extension of the arms and returning it to the chest. At the completion of a period of exercising, the user must again lift the weight bar to the full extension of his arms to return the weight bar to the rack. Obviously, when the user is fatigued, as is often the case when the user has forced himself to perform more repetitions than he felt was his capacity, which techinque is commonly called "overloading", the return of the weight bar to the rack is difficult or even dangerous.

Although weightlifters and bodybuilders know that safety should be of primary concern and that a second person should be ready to help or to remove the weight bar when such help is needed, the pressures of time and the availability of equipment for exercising lead them to ignore this important safeguard. Even when the safeguard is observed, injury can occur if the second person, the "spotter", takes inappropriate or unexpected action in his efforts to provide help to the exerciser.

The standards for weightlifting competition in bench press events require that the exercise be performed with the exerciser's feet planted firmly on the floor. This position accomplishes several goals; among them is the limiting of the lift to the use of only certain muscle groups in the arms and upper torso. Arching the back by raising up on one's toes can bring different factors into play that could alter performance of the exercise and may subject the weightlifter to disqualification from the competition under rules that are designed to protect the competitor from potential self-injury. Also, the feet, along with the back, provide the major points of balance for performing the exercise. If the exercise is performed in practice without using the feet well planted on the floor, the weightlifter is not reinforcing the skill necessary to achieve success in competition. Thus it can be seen that the needs of the weightlifter in training may differ from those of the bodybuilder in training. A bodybuilder may be somewhat less concerned with his lifting style and more concerned with the resulting effect on building muscle mass for appearance, even though the proper lifting techinque is considered by most experts to also be the most effective for efficiently building muscle mass. The weightlifter in training for power lifting competition, on the other hand, needs to practice performing the lift according to competitive standards so the competition lift feels natural.

Recent developments in the art of bodybuilding teach that greater effectiveness is obtained by exercising in the so-called "eccentric contraction" mode. To adherents of the eccentric contraction method, lifting the weight bar against the pull of gravity is considered less effective in building or developing muscle tissue than is slowly lowering the weight from the initial full extension to the contracted position wherein, for the bench press, the weight bar is near the chest.

The adherents of the eccentric contraction mode would prefer to have aid from a source other than the muscle group being exercised to lift the weight; they then exercise the desired muscle group primarily during the slow lowering of the weight bar. When a spotter is used to accomplish this mode of exercise, the transfer of the weight bar from the user to the spotter and back again while it is always positioned above the user's reclining body carries obvious hazards with respect to timing and coordination of the efforts of the two people to prevent the heavily-weighted bar from being dropped, causing serious injury to the user.

From the standpoint of time utilization, it would be desirable have equipment that would make the bench press exercises described herein suitable to be performed by a solitary user without a spotter, even for the adherents of eccentric contraction or users of forced repetitions, while at the same time improving the safety of the exercise.

DISCUSSION OF PRIOR ART

A significant contribution to the safety of the user of a free-bar bench press exercise was taught in U.S. Pat. No. 4,256,301, issued to R. G. Goyette. Goyette teaches the use of a weighted bar suspended from an overhead tower by means of a cable passing through a pulley, thence to foot member, bar, or element slidably mounted on a secondary frame assebly mounted on the foot end of the bench. Movement of the foot element towards the foot end of the bench will cause the cable to elevate the weighted bar. One should note that there lacks in Goyette a desirable one-to-one ratio between the motion of the foot element and the motion of the weighted bar. In addition, the presence of the secondary frame assembly and foot element severely restricts the movement of the exerciser in mounting, dismounting, and especially in opting to make use of the foot member after a period of exercising without engaging the foot element. Presumably, the exerciser would be in a supine position with legs extended beneath the foot element (and not on the floor) during exercise not employing the foot element. Should he encounter difficulty in raising the weight from his chest, the foot element would be in a position on the secondary frame assembly nearest the head end of the bench, in which position the foot element presents itself as a barrier to the exerciser's raising of his legs to enagage the foot element with his feet. Although an alternative exercise position would have the exerciser straddle that portion of the bench occupied by the secondary frame, that position would be exceptionally inconvenient. Thus, although Goyette allows the exerciser to safely bench press a weight at or near the limit of his strength, he does not provide for forced repetitions in a standard, foot-planted exercise position with easy transition to a foot-aided lift when the exerciser is exhausted; neither does Goyette provide an adjustable safety stop, much less a self-positioning safety stop; these features are provided for in the present application. The apparatus taught by Goyette does is not seen by applicant as allowing the execution of the standard bench press.

U.S. Pat. No. 4,471,956, issued to S. M. Marlo, teaches the use of a cable-tethered weight bar wherein the cable leads to a safety weight that, when released by a trip lever operated by the user's foot, counterbalances part of the weight of the weight bar to help the user lift the bar to return it to the rack. Thus, after several forced reps to the point of severe fatigue, the user merely trips the foot-operated trip lever for help to return the bar to the rack. An added feature to protect the user if the bar is accidentally dropped is that a protruberance on the cable engages a pulley and stops excessive downward movement of the weight bar. Although this patent has much merit, there are some obvious shortcomings. The trip lever must be re-strung with the safety cable after each use. The main cable is slack during the exercise and can easily jam in the pulleys to the extent that the counterweight feature is completely disabled. In contrast, spring tension is always applied to the cable of the present invention, thereby to keep the cable riding safely in the pulleys.

U.S. Pat. No. 4,252,314, issued to L. Ceppo, teaches a device for performing weight lifting exercises that includes connecting a slidably guided weight bar by means of overhead cables to stirrups engaged by the feet before bench press exercises involving forced reps are begun. The user may therefore use his legs to assist the lifting of the weight bar during forced reps. Since the rest position of the weight bar is not on an elevated rack, but rather on stops that provide clearance above the user's chest, and since the stirrups are in a position to require a pulling force to be exerted downward by the feet in a manner wherein we observe that leverage is minimal, the reason for providing the cable and stirrups as an aid to bench pressing is unclear. Ceppo's apparatus would be inappropriate for use by a weightlifter in training as the proper standard bench press position and the good base for proper balance commensurate with the standard position is not enabled by the apparatus.

U.S. Pat. No. 4,561,651, issued to R. W. Hole, teaches a free-bar simulating bench press apparatus wherein the weight bar is tethered by cables to tension-maintaining weights that serve as safety stops that engage adjustably-positioned barriers to prevent the weight bar from falling upon the user. This patent although it provides safety to the user of the apparatus does not include any provision to help the user of the apparatus to return the weight bar to the rack after forced reps, nor does it offer the advantages to be had by using the eccentric contraction techingue with an assisted lifting and unassisted lowering of the weight bar.

The improvement offered by the present invention lies not only in the inherent safety of having a bench press exercise device closely simulating free-bar exercising using the correct and standard bench press technique wherein the feet are on the floor for proper balance, but with a tethered bar including an adjustable and automatically positioned safety stop to prevent the bar from injuring the exerciser; it also provides for safety in the practice of eccentric contraction exercises in the bench press position, even without the use of a spotter. No exercise device has ever provided these benefits coupled with the many advantages that are present only in free-bar exercising. The present invention not only provides these benefits, but for the exerciser using a reasonable amount of care and judgement in its use, provides for safe bench press exercising in the various modes described by a solo exerciser.

DETAILED DESCRIPTION OF THE INVENTION

Figure 1:
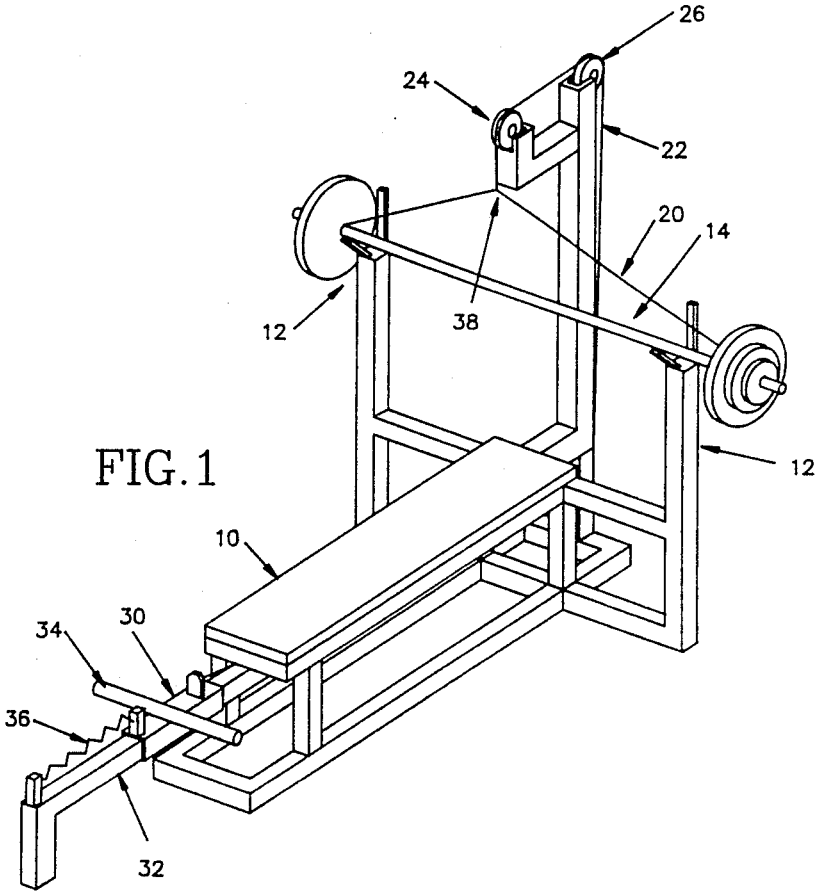
FIG. 1 is a perspective view of the apparatus of this invention.
Figure 2:
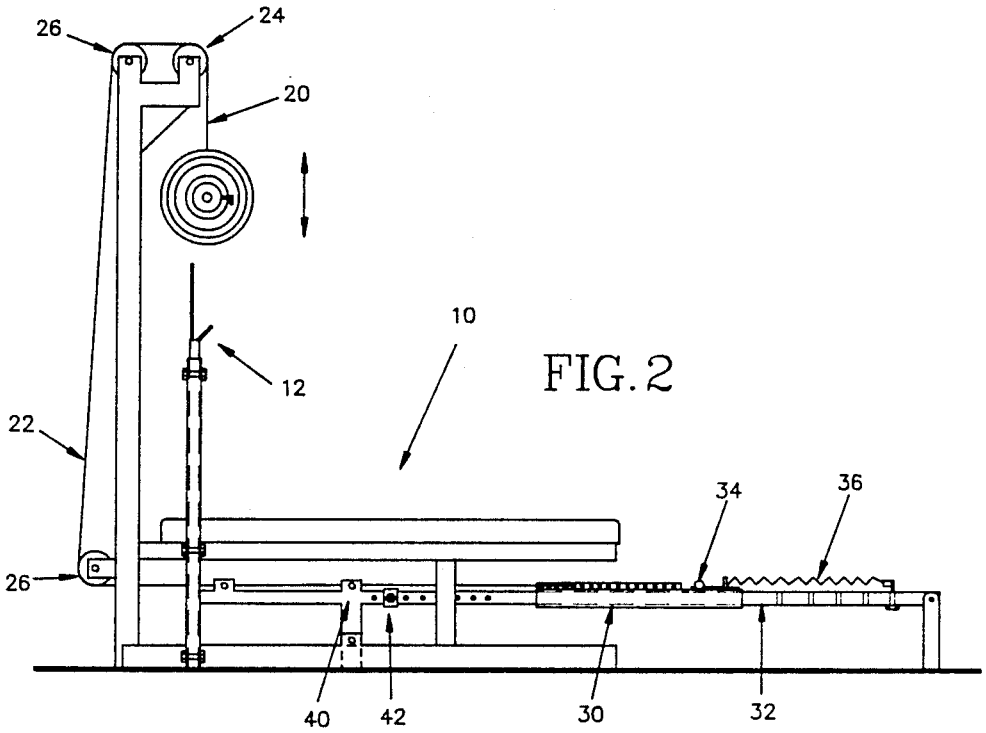
FIG. 2 is a side view of the apparatus of this invention.

With reference to FIG. 1 and FIG. 2 of the drawings, this invention comprises an apparatus for performing the weight-lifting exercise commonly known as a bench press, which exercise is executed while in a supine position, on a bench 10 with his feet firmly planted on the floor. In an operative location adjacent the arms of the exerciser in said supine position on the bench 10 are means 12 to support the weighted bar 14, generally with one such means on either side of the bench, thus positioning the bar above the bench in a transverse orientation relative thereto. This is the rest position of the weighted bar and the bar is said to be "on the racks". For a simple bench for a bench pressing station, the articles of apparatus thus far described would complete the apparatus. Such a bench pressing station is the simplest and most hazardous to the exerciser, especially when he is fatigued, and more especially if he chooses to exercise alone.

The apparatus of the present invention further comprises flexible and relatively inelastic connecting means 20 and 22, such as cable or chain for examples, connecting the weight bar 14 through an overhead guide means 24, preferably a pulley, and through other guide means 26, such as a tube or additional pulleys for examples, to a guided sled device 30 that is captively and slidably mounted on a track 32 in an operable position adjacent the feet of the supine-positioned exerciser. A foot-engaging means 34 on the sled is in close proximity to the floor and may be engaged at the exerciser's option anytime during exercising using the apparatus.

The user, during his exercise, need only cock his feet back on his heels for the balls of his feet to be at an elevation to engage the foot-engaging means. Thus, the feet remain in contact with the floor until they have engaged the sled. Balance may then be maintained by the contact with the foot engaging means of the sled, rather than the floor.

Thus it can be seen that the weightlifter using this equipment can practice or exercise in the competition-approved position and, when and if he desires to use his leg muscles to aid his lift, he can easily shift to that mode of exercise at will and without any pre-selecting on his part before the exercise begins. This ability is not available in any free-bar bench press exercise equipment heretofore available.

Several points of attachment between the connecting means 22 and ~~the~~ sled device 30 are provided for the user to select an appropriate attaching point best suited to his height and arm length.

A spring means 36 serves the primary purpose of maintaining the connecting means 20 and 22 in slight tension to keep them in proper engagement with the guide means, especially the overhead guide means 24, which is preferably a pulley. The spring 36 attaches at one end to a fixed but adjustable point the track 32 and at its other end to the sled device 30, acting upon the sled device 30 causing it to move in reaction to the spring 36, thereby creating the desired tension in the connecting means 22 and therethrough to connecting means 20. The spring may be positioned as shown in the figures and designed to be in tension, or it may alternatively be positioned in a different location, such as within the rail for example, where it might be designed to be in compression. In either case, the connecting means 22 will be kept in tension by the motion of the sled device 30 reacting to the spring.

The connecting means 20 is preferably a yoke of cable or chain firmly attached to collars that completely surround the bar upon which the weights are mounted. These collars are preferably placed on the bar before any of the removable weights are placed on the bar; in this way, there is no oportunity for the cable to be abraded by contact with the weights. While it is possible for this yoke to be of one piece of cable or chain, threaded through an eye or other attaching means that would provide slidable attachment to the end of connecting means 22 at their juncture 38, it is preferable for the connecting means 20 to comprise two lengths of cable or chain that meet at juncture 38 where hooks, eyes, or other attaching means attached to each cable also attach to an eye or other attaching means at the end of connecting means 22.

An important safety feature of this apparatus is a safety stop that prevents the weighted bar from decending beyond a pre-set point. With the weight bar being tethered by connecting means 20 and 22 which attach to the sled device, it is a simple matter to include a safety stop that would be a permanent fixed barrier to motion of the sled beyond a fixed point. Such an ultimate safety stop is provided at 40.

It is also desirable, however, to include a safety stop that is adjustable to suit the exerciser for the exercise he is performing, or to limit motion for exercising injured muscles. For this purpose, a bolt or a pin may be inserted into the selected one of a series of holes in the track 32 such that the sled device 30 would be barred by contact with the bolt or pin from motion beyond the selected point. It would be most advantageous when using such a safety stop to have an assistant observe the location of the sled for selecting the hole for inserting the stop. Otherwise the setting of the stop may be done by trial and error.

The preferred safety stop, however, is one that is designed to safely and easily establish its own position for safe exercising. An inverted 'U'-shaped stop element 42 or stop element of other shape that slidably engages the track 32 on at least the top and two sides thereof and having aligned, preferably transverse, holes that may be aligned with similar holes in the track, permitting the insertion of a bolt or a pin to hold the stop element in a selectable fixed position has been devised.

Figure 3:
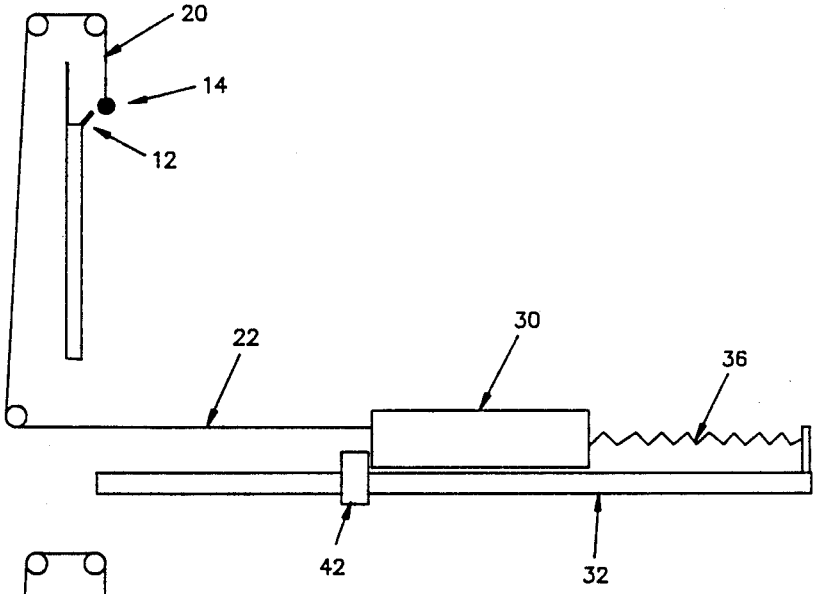
FIG. 3 is a representational drawing of the working parts of the apparatus of this invention as in the side view of FIG. 3.
Figure 4:
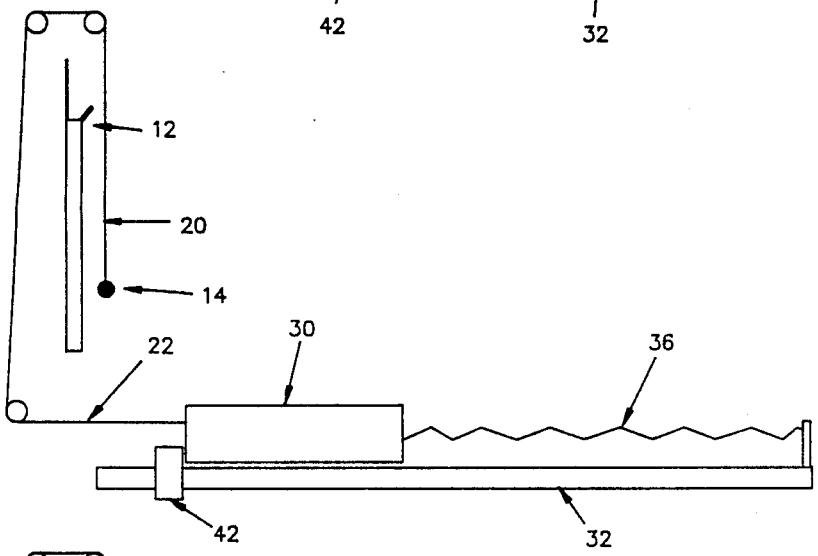
FIG. 4 is a representational drawing similar to FIG. 3.
Figure 5:
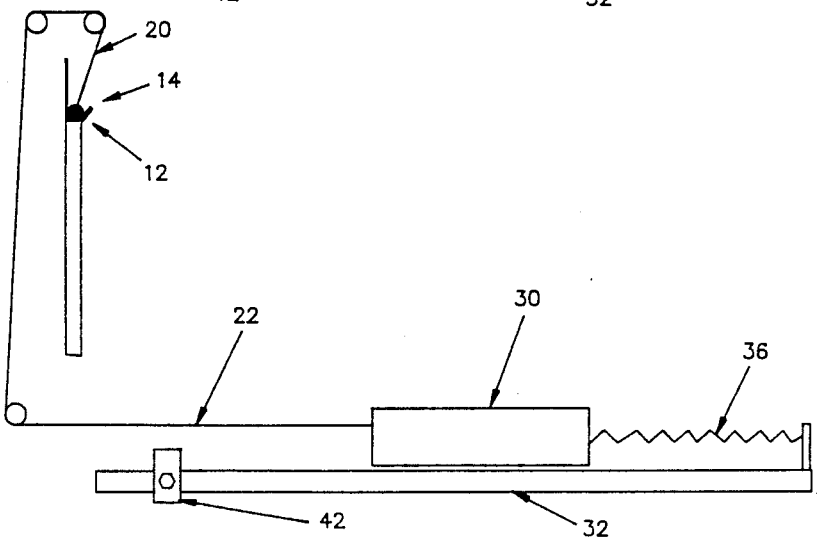
FIG. 5 is a representational drawing similar to FIG. 3.

Attention is now directed to FIGS. 3, 4, and 5, which illustrate in representational form the method for setting the safety stop that is a part of this invention. Safety stops of prior art exercise devices are set by the experience of trial and error or by the assistance of a second person. The safety stop of this invention is set automatically by the user, who may be working alone.

With the weight bar 14 unloaded and on the rack, the pin is removed from the safety stop 42 and the stop is positioned on the rail 32 against the sled 30. The user then assumes the exercise position on the bench 10, removes the bar 14 from the rack 12, as shown in FIG. 3, and lowers the unloaded bar to the lowest position desired for that exercise session, as shown in FIG. 4; then the bar 14 is returned to the rack 12 and the bolt or pin is inserted, as in FIG. 5. In performing this simple act, the downward movement of the bar 14 was transmitted by the connecting means 20 and 22 and resulted in the sliding of the sled 30, pushing the freely-sliding safety stop 42 to its desired position. The pin is inserted into the set of holes that are in the closest alignment (some minor adjustment may be necessary) and the safety stop 42 is set at the exact point desired by the user. Weights may then be applied to the bar 14 and safe exercising can begin.

This safe and accurate method of setting the safety stop eliminates the need for a second person to be present and eliminates the trial-and-error method of setting a safety stop. The method is made possible by the use of the connecting means 20 and 22 in combination with a sliding means, in this case the sled 30, on a track means 32.

The method can be modified for more accurate positioning by having a series of holes in an elongated stop means 42 with a linear array of holes whose spacing is not the same as that of the holes in the track, but the array spans two or more of the array of holes in the track; thus the alignment of one of the sets of holes of the array on the stop means 42 with one of the array of holes in the track will be the most precise and the position will be altered less for the insertion of a bolt or a pin. The principle described is similar to a vernier scale on measuring tools such as calipers.

A second method of modifying the holes in the safety stop would be to make the distance between centers of adjacent holes in a linear array of holes smaller than the diameter of the hole, so that the holes join to form what may be described as a slot with serrated edges. Thus the movement of the safety stop 42 to achieve alignment of one of its holes with a hole in the track would be less than the diameter of one hole. Other means to achieve more accurate setting of the sliding safety stop may be available.

While a preferred embodiment of the invention has been shown and described, it should be understood that there is no intent to limit the invention by such disclosure, but rather, the invention is intended to cover all modifications and alternate constructions falling within the spirit and the scope of the invention as defined in the appended claims for which I seek protection by means of Letters Patent.

I claim:

1. An apparatus for training weightlifters in performing the weight-lifting exercise commonly known as the standard bench press, which exercise is correctly executed by an exerciser while in a supine position on a substantially horizontal bench generally supporting the head and torso of the exerciser with his feet resting on the floor, said apparatus comprising means defining a weight-lifting station comprising:

a. a substantially horizontal bench capable of supporting the ~~head~~ and torso of the exerciser;

b. a weight bar having selected exercise weights removably attached thereto;

c. a track and a guided sled device captively and slidably mounted on said track and in operative position adjacent the feet of said supine-positioned exerciser and beyond the end of said bench proximal to exerciser's feet, said feet normally resting on the floor to provide balancing support for the exerciser;

d. a flexible elongated connecting means connecting said weight bar through at least one overhead guide means and through other guide means to said sled device;

e. and foot-engaging means mounted on said sled device in close proximity to the floor such that said foot engaging means may be engaged at said exerciser's option at any time during exercising use of said apparatus without the need to lift his heels from the floor and thereby to lose said balancing support in effecting such engagement; whereby said weight bar, normally lifted by a pushing force exerted by the arms of said exerciser, may additionally be lifted by a pulling force exerted by said cable, which pulling force is generated by said exerciser's applying a second pushing force on said sled with his feet.

2. The apparatus described in claim 1, wherein said flexible connecting means is maintained in tension while the apparatus is in use, and said tension is maintained by spring means connecting said sled device at an attachment point thereon to said track at an adjustable attachment point thereon, such that the tension may be adjusted.

3. The apparatus described in claim 1, wherein the effective length of said flexible connecting means is adjustable to accommodate exercisers of various physical size.

4. The apparatus described in claim 3, wherein the effective length of said flexible connecting means may be adjusted by selecting from two or more attachment points provided on said sled device.

5. The apparatus described in claim 1, wherein the downward motion of the weight bar is limited by a mechanical stop means having an operative location on said track for said interconnected sled device, which stop means location may be adjustable.

6. The apparatus described in claim 5, wherein said mechanical stop means comprises at least two holes in the rail upon which the sled device rides in combination with a cooperating pin sliding motion of said sled device on said rail.

7. The apparatus described in claim 5, wherein said mechanical stop means comprises at least one hole in the rail upon which the sled device rides, a member surrounding a portion of said rail on at least three sides and slideable on said rail and having at least one hole that may be aligned with one said hole in said rail, and a cooperating pin removably insertable into a selected set of aligned holes so that, when said pin is inserted it holds said surrounding member in place to limit in one direction the sliding motion of said sled device on said rail.

8. The apparatus described in claim 1, wherein said track is substantially horizontally orientated and extends beneath said bench provided for the exerciser.

9. The apparatus described in claim 1, wherein a substantially one-to-one ratio exists between the motion of said sled device and that of said weight bar.

10. The apparatus described in claim 9, wherein said ratio has a magnitude in the range of 0.8 and 1.2.

11. The apparatus described in claim 9, wherein said ratio has a magnitude in the range of 0.9 and 1.1.

12. The apparatus described in claim 1, wherein said second pushing force is in a direction away from said end of the bench proximal to the exerciser's feet.

* * * * *